US010879646B2

(12) United States Patent
Shimomaki et al.

(10) Patent No.: US 10,879,646 B2
(45) Date of Patent: Dec. 29, 2020

(54) CONNECTOR ASSEMBLY

(71) Applicant: JAPAN AVIATION ELECTRONICS INDUSTRY, LIMITED, Tokyo (JP)

(72) Inventors: Yuta Shimomaki, Tokyo (JP); Masahide Watanabe, Tokyo (JP); Junji Oosaka, Tokyo (JP); Isao Igarashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/669,511

(22) Filed: Oct. 30, 2019

(65) Prior Publication Data

US 2020/0194931 A1 Jun. 18, 2020

(30) Foreign Application Priority Data

Dec. 14, 2018 (JP) ..... 2018-234684

(51) Int. Cl.
*H01R 13/627* (2006.01)
*H01R 13/639* (2006.01)
(Continued)

(52) U.S. Cl.
CPC ..... *H01R 13/6272* (2013.01); *H01R 13/422* (2013.01); *H01R 13/436* (2013.01);
(Continued)

(58) Field of Classification Search
CPC ..... H01R 13/6594; H01R 13/6595; H01R 13/6272; H01R 13/639; H01R 13/516;
(Continued)

(56) References Cited

U.S. PATENT DOCUMENTS 4,470,657 A 9/1984 Deacon
5,904,595 A * 5/1999 Tanigawa ..... H01R 13/6593 439/607.58
(Continued)

FOREIGN PATENT DOCUMENTS

CN 104319577 B 5/2016
JP 2017068947 A 4/2017
JP 2017091915 A 5/2017

OTHER PUBLICATIONS

Extended European Search Report (EESR) dated Apr. 20, 2020 issued in European Application No. 19202991.6.

*Primary Examiner* — Gary F Paumen
(74) *Attorney, Agent, or Firm* — Holtz, Holtz & Volek PC

(57) ABSTRACT

A connector assembly comprises a first connector and a second connector. The first connector comprises a first inner structure and a first housing. The first inner structure comprises a first connector main body. The second connector comprises a second inner structure and a second housing. The second inner structure comprises a second connector main body. The second connector main body comprises a plurality of second terminals, a second holding member and a second shell. The second connector main body is mated with the first connector main body under a mated state where the first connector and the second connector are mated with each other. A distance from a front end of the first housing to a rear end of the second shell is shorter than a distance from a rear end of the second housing to the rear end of the second shell in a front-rear direction under the mated state.

10 Claims, 8 Drawing Sheets

(51) Int. Cl.

| | |
|---|---|
| ***H01R 13/516*** | (2006.01) |
| ***H01R 24/60*** | (2011.01) |
| ***H01R 13/422*** | (2006.01) |
| ***H01R 13/436*** | (2006.01) |
| ***H01R 13/631*** | (2006.01) |

(52) U.S. Cl.
CPC ..... *H01R 13/516* (2013.01); *H01R 13/631* (2013.01); *H01R 13/639* (2013.01); *H01R 24/60* (2013.01)

(58) Field of Classification Search
CPC .. H01R 13/422; H01R 13/436; H01R 13/631; H01R 24/60
USPC ..... 439/607.35–607.4, 607.58
See application file for complete search history.

(56) References Cited

U.S. PATENT DOCUMENTS

| | | | | |
|---|---|---|---|---|
| 5,911,599 | A * | 6/1999 | Masuda ..... | H01R 13/6592 439/578 |
| 6,830,472 | B1 | 12/2004 | Wu | |
| 9,472,911 | B2 | 10/2016 | Little et al. | |
| 9,666,987 | B1 | 5/2017 | Tanaka et al. | |
| 9,905,965 | B2 | 2/2018 | Tanaka et al. | |
| 9,935,398 | B2 | 4/2018 | Yokoyama | |
| 10,490,940 | B2 | 11/2019 | Ju | |
| 2009/0209130 | A1* | 8/2009 | Kameyama ..... | H01R 23/6873 439/607.27 |
| 2017/0093086 | A1 | 3/2017 | Tanaka et al. | |
| 2017/0141514 | A1 | 5/2017 | Tanaka et al. | |
| 2018/0145460 | A1 | 5/2018 | Ju | |
| 2018/0241154 | A1 | 8/2018 | Khorrami et al. | |
| 2020/0153169 | A1* | 5/2020 | Yamaguchi ..... | H01R 13/6582 |

* cited by examiner

CONNECTOR ASSEMBLY

CROSS REFERENCE TO RELATED APPLICATIONS

This application is based on and claims priority under 35 U.S.C. § 119 to Japanese Patent Application No. JP2018-234684 filed Dec. 14, 2018, the contents of which are incorporated herein in their entireties by reference.

BACKGROUND OF THE INVENTION

This invention relates to a connector assembly comprising a first connector and a second connector, wherein the first connector is attachable to a cable while the second connector is mateable with the first connector.

Referring to FIGS. 13 to 15, U.S. Pat. No. 9,472,911B (Patent Document 1) discloses a connector assembly 900 of this type. The connector assembly 900 comprises a first connector 910 and a second connector 950. The first connector 910 is attachable to a cable 980 having a plurality of core wires (not shown). The second connector 950 is mateable with the first connector 910 along a Y-direction. The first connector 910 comprises a first inner structure 920 and a first housing 940. The first inner structure 920 comprises a first connector main body 922. The first connector main body 922 comprises a plurality of first terminals 924, a first holding member 926 and a first shell 928. The first terminals 924 are connected with the core wires, respectively, of the cable 980 when the first connector 910 is attached to the cable 980. The first terminals 924 are held by the first holding member 926. The first terminals 924 are arranged in an X-direction. The first shell 928 surrounds the first terminals 924 and the first holding member 926 in a plane perpendicular to the Y-direction. The first housing 940 has a cable holding portion 942. The cable holding portion 942 directly holds the cable 980 when the first connector 910 is attached to the cable 980. The second connector 950 comprises a second inner structure 960 and a second housing 970. The second inner structure 960 comprises a second connector main body 962. The second connector main body 962 is mated with the first connector main body 922 under a mated state where the first connector 910 and the second connector 950 are mated with each other. The second connector main body 962 comprises a plurality of second terminals 964, a second holding member 966 and a second shell 968. The second terminals 964 are connected with the first terminals 924, respectively, under the mated state. The second holding member 966 holds the second terminals 964. The second shell 968 surrounds the second terminals 964 and the second holding member 966 in the plane perpendicular to the Y-direction. The second shell 968 partially receives the first shell 928 under the mated state. The second housing 970 accommodates and holds the second connector main body 962. The second housing 970 partially receives the first housing 940 under the mated state.

When an external force is applied to the cable 980 attached with the first connector 910 which is mated with the second connector 950, the connector assembly 900 of Patent Document 1 may receive stress which is applied to mating parts of the first shell 928 of the first connector 910 and the second shell 968 of the second connector 950 to break the mating parts.

SUMMARY OF THE INVENTION

It is therefore an object of the present invention to provide a connector assembly whose mating parts are prevented from being broken when an external force is applied to a cable under a mated state.

One aspect of the present invention provides a connector assembly comprising a first connector and a second connector. The first connector is attachable to a cable having a plurality of core wires. The second connector is mateable with the first connector along a front-rear direction. The first connector comprises a first inner structure and a first housing. The first inner structure comprises a first connector main body. The first connector main body comprises a plurality of first terminals, a first holding member and a first shell. The first terminals are connected with the core wires, respectively, when the first connector is attached to the cable. The first terminals are held by the first holding member. The first terminals are arranged in a pitch direction perpendicular to the front-rear direction. The first shell surrounds, at least in part, the first terminals and the first holding member in a perpendicular plane perpendicular to the front-rear direction. The first housing has a front holding portion and a rear holding portion. The first housing has a front end in the front-rear direction. The front holding portion is positioned between the front end and the rear holding portion in the front-rear direction. The front holding portion holds the first inner structure and regulates a movement of the first inner structure in an up-down direction which is perpendicular to both the front-rear direction and the pitch direction. The rear holding portion directly or indirectly holds the cable when the first connector is attached to the cable. The second connector comprises a second inner structure and a second housing. The second inner structure comprises a second connector main body. The second connector main body is mated with the first connector main body under a mated state where the first connector and the second connector are mated with each other. The second connector main body comprises a plurality of second terminals, a second holding member and a second shell. The second terminals are connected with the first terminals, respectively, under the mated state. The second holding member holds the second terminals. The second shell surrounds, at least in part, the second terminals and the second holding member in the perpendicular plane. The second shell partially receives the first shell under the mated state. The second shell has a rear end in the front-rear direction. The second housing accommodates and holds the second connector main body. The second housing partially receives the first housing under the mated state. The second housing has a rear end in the front-rear direction. A distance from the front end of the first housing to the rear end of the second shell is shorter than a distance from the rear end of the second housing to the rear end of the second shell in the front-rear direction under the mated state.

The connector assembly of the present invention has a configuration where the distance from the front end of the first housing to the rear end of the second shell is shorter than the distance from the rear end of the second housing to the rear end of the second shell in the front-rear direction under the mated state where the first connector and the second connector are mated with each other. Accordingly, when an external force is applied to the cable under the mated state, the rear end of the second housing, which is nearer to the cable than the rear end of the second shell, abuts against an outer circumference of the first housing to regulate a movement of the cable, and then the front end of the first housing abuts against the second housing therein to further regulate the movement of the cable. These abutments can effectively distribute a force which is applied to mating parts of the first shell and the second shell of the connector assembly of the present invention. In other words, the connector assembly of the present invention prevents the mating parts of the first shell and the second shell from being broken when an external force is applied to the cable under the mated state.

An appreciation of the objectives of the present invention and a more complete understanding of its structure may be had by studying the following description of the preferred embodiment and by referring to the accompanying drawings.

Figure 1:
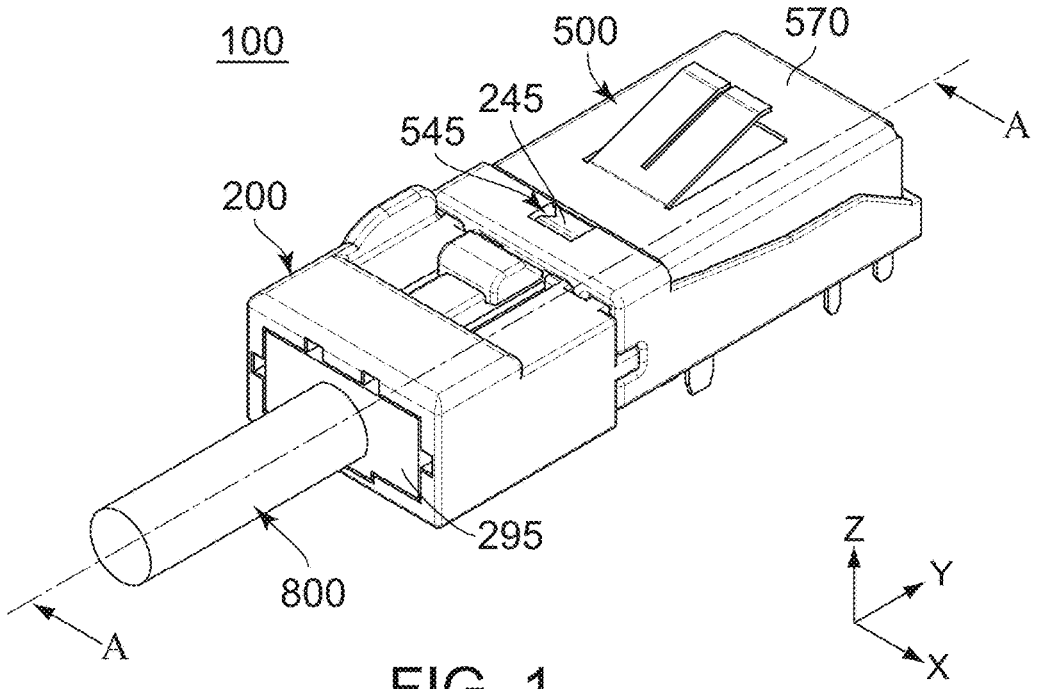
FIG. 1 is a perspective view showing a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
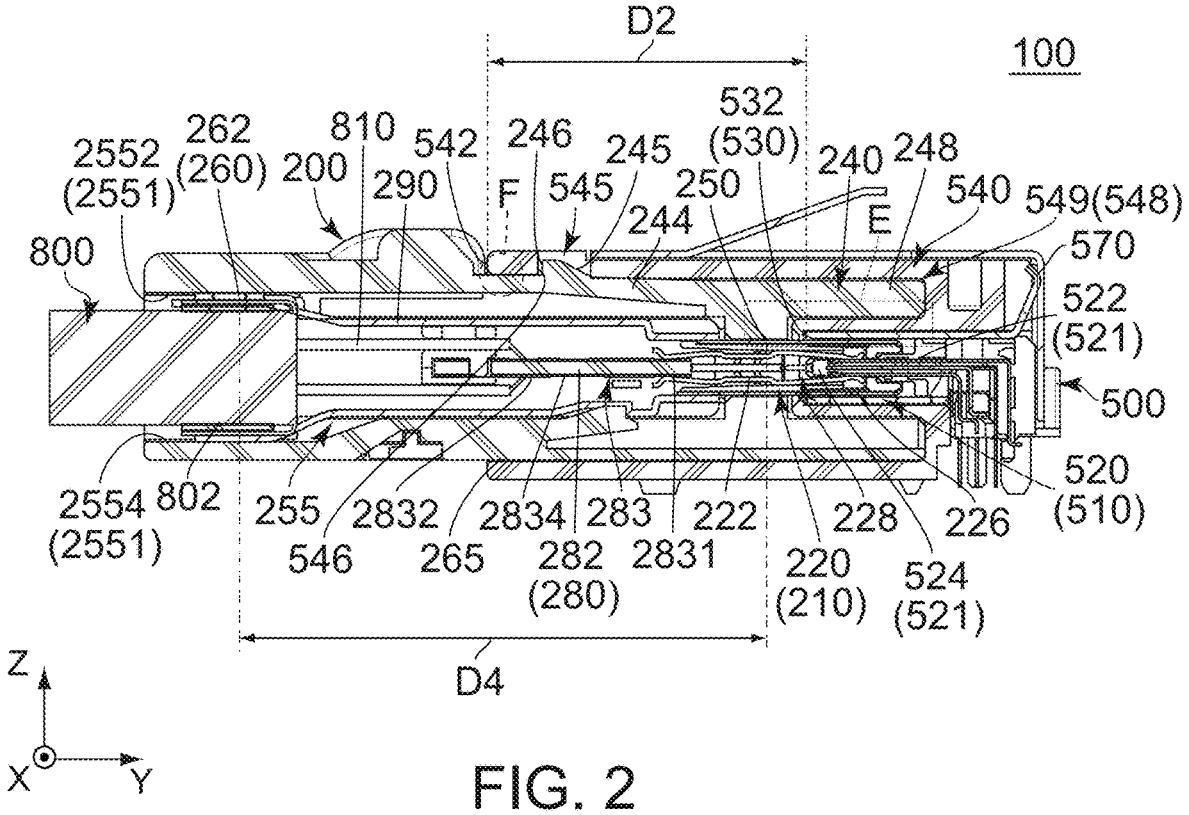
FIG. 2 is a cross-sectional view showing the connector assembly of FIG. 1, taken along line A-A.

Referring to FIGS. 1 and 2, a connector assembly 100 according to an embodiment of the present invention comprises a first connector 200 and a second connector 500. The first connector 200 is attachable to a cable 800. The cable 800 has a plurality of core wires 810. The second connector 500 is mateable with the first connector 200 along a front-rear direction. In the present embodiment, the front-rear direction is a Y-direction. Specifically, it is assumed that forward is a positive Y-direction while rearward is a negative Y-direction. As described below, the connector assembly 100 of the present embodiment is configured to prevent reverse insertion of the first connector 200 into the second connector 500.

Figure 8:
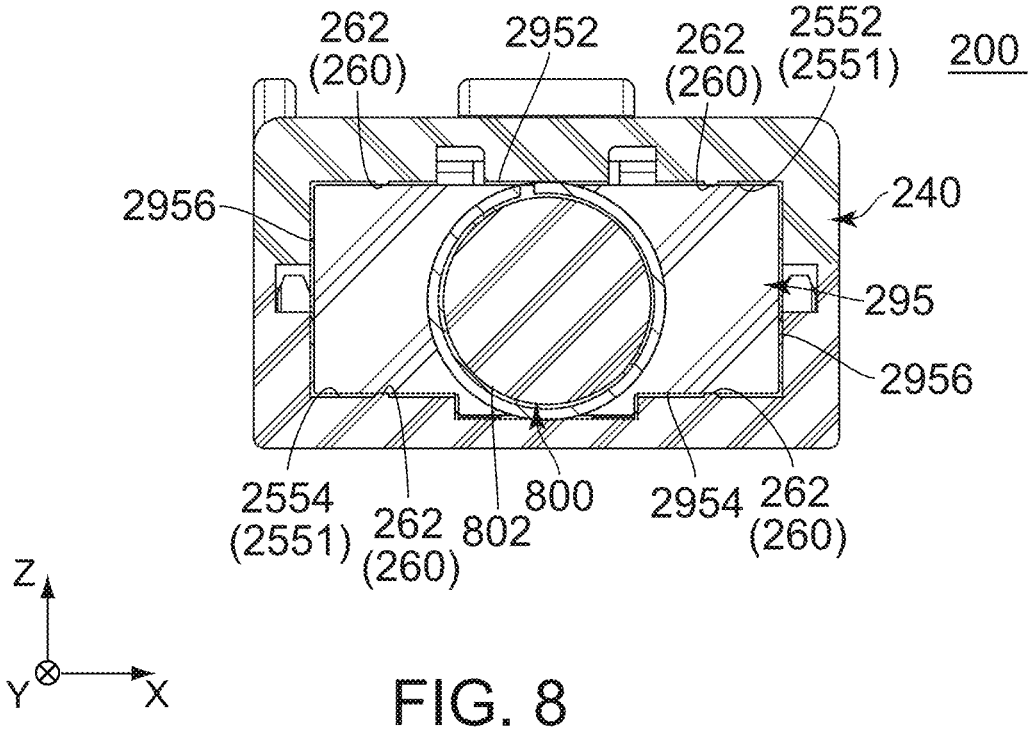
FIG. 8 is a cross-sectional view showing the first connector of FIG. 7, taken along line C-C.

Referring to FIGS. 2 and 8, the cable 800 of the present embodiment has a jacket 802 and the core wires 810. The jacket 802 is made of insulator. Each of the core wires 810 is made of conductor. Each of the core wires 810 is covered by an insulative covering (not shown) before the cable 800 is attached to the first connector 200.

Figure 6:
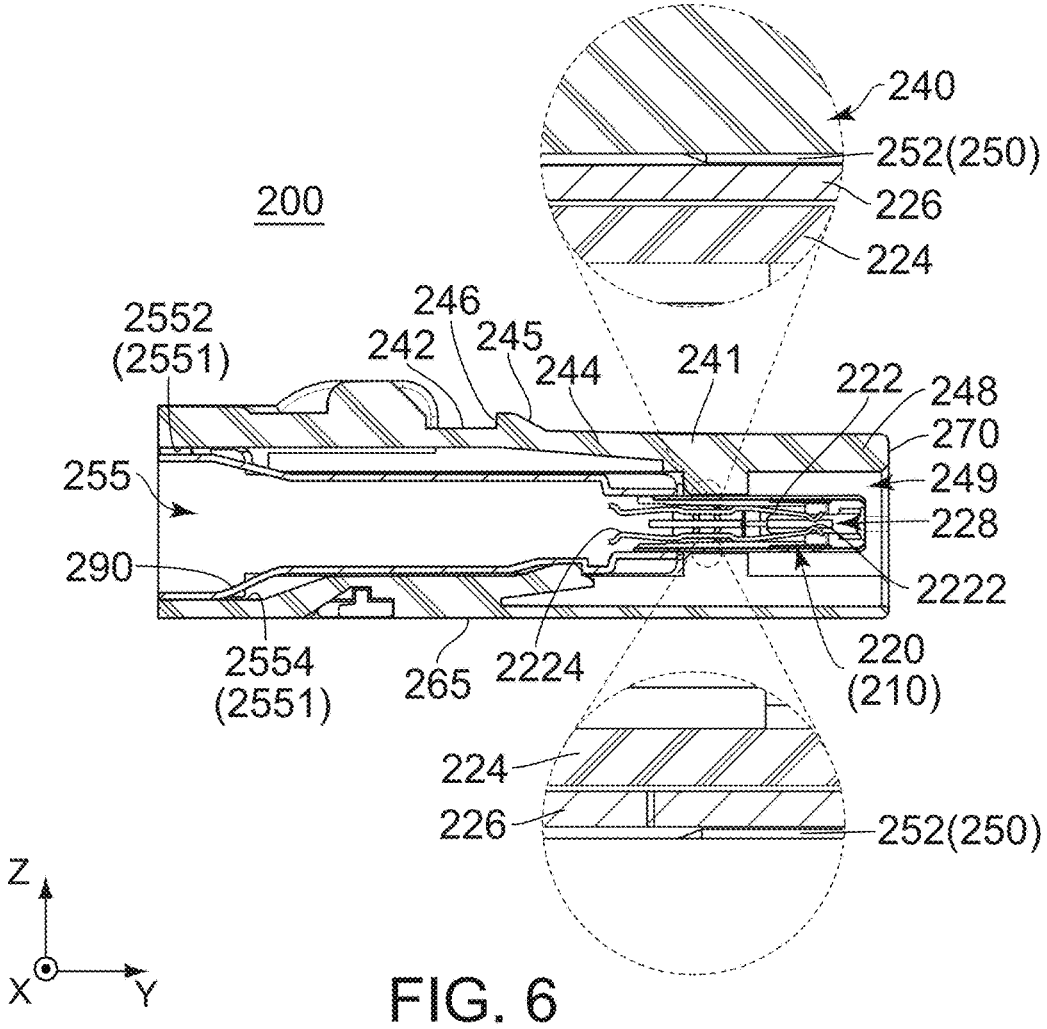
FIG. 6 is a cross-sectional view showing a part of the first connector of FIG. 5, taken along line B-B. In the figure, a front holding portion and its surrounding parts are illustrated enlarged, and a relay board and a cable holding portion are omitted.

As shown in FIG. 6, the first connector 200 of the present embodiment comprises a first housing 240 and a first inner structure 210.

As shown in FIGS. 6 and 8, the first housing 240 of the present embodiment has a received portion 248, a front holding portion 250, an accommodating portion 255, a rear holding portion 260, an upper plate portion 241 and an outer circumference 265.

Figure 9:
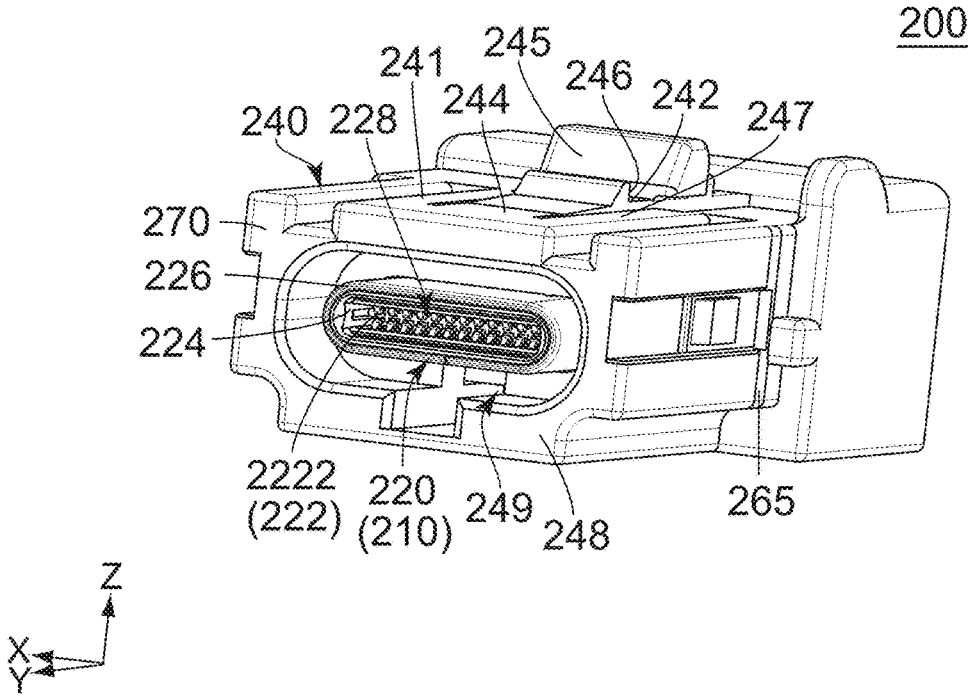
FIG. 9 is a front, perspective view showing the first connector of FIG. 5.

As shown in FIGS. 6 and 9, the received portion 248 of the present embodiment has a shape which is rotationally asymmetric about an axis extending in the front-rear direction. The received portion 248 is opened forward in the front-rear direction. The received portion 248 has a second connector main body accommodating portion 249. The received portion 248 has a front end 270 in the front-rear direction. In other words, the first housing 240 has the front end 270 in the front-rear direction. The front end 270 of the present embodiment is the forwardmost end of the first housing 240.

As shown in FIG. 6, the front holding portion 250 of the present embodiment is positioned rearward of the received portion 248 in the front-rear direction. The front holding portion 250 protrudes inward in an up-down direction perpendicular to both the front-rear direction and a pitch direction. In the present embodiment, the pitch direction is an X-direction while the up-down direction is a Z-direction. It is assumed that upward is a positive Z-direction while downward is a negative Z-direction. The front holding portion 250 includes four front ribs 252. Each of two of the front ribs 252 protrudes downward in the up-down direction. Each of remaining two of the front ribs 252 protrudes upward in the up-down direction. The two front ribs 252 are positioned above the remaining two front ribs 252 in the up-down direction.

Figure 7:
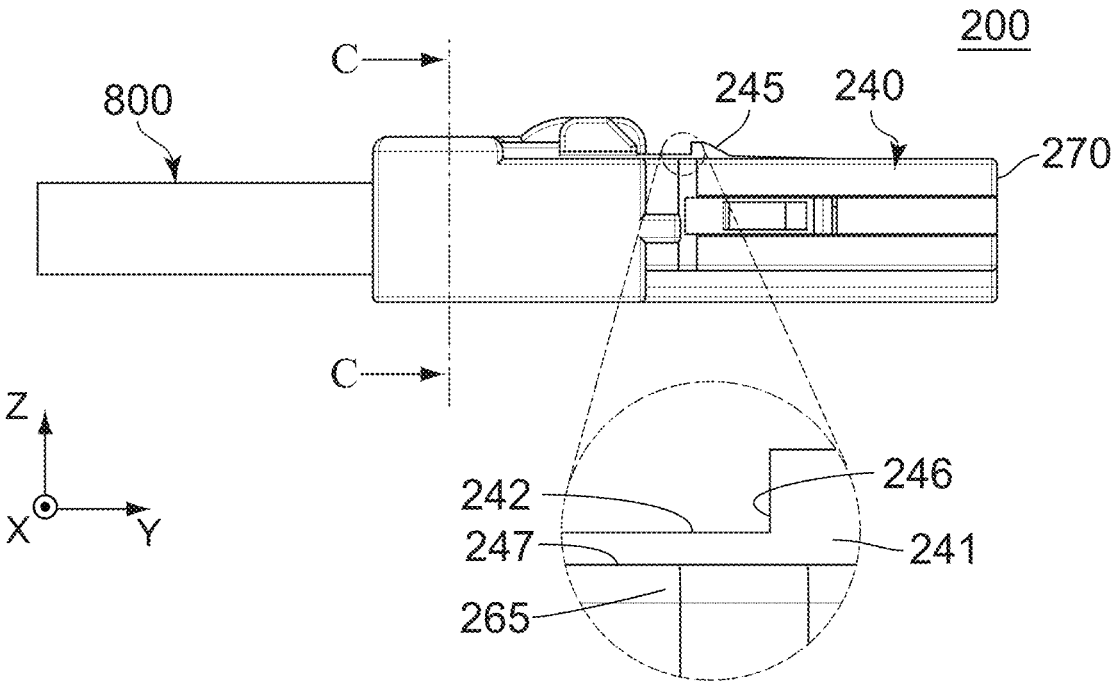
FIG. 7 is a side view showing the first connector of FIG. 5. In the figure, a first lock portion and its surrounding parts are illustrated enlarged.

As understood from FIGS. 6 to 8, the front holding portion 250 of the present embodiment is positioned between the front end 270 and the rear holding portion 260 in the front-rear direction. The front holding portion 250 holds the first inner structure 210 and regulates a movement of the first inner structure 210 in the up-down direction which is perpendicular to both the front-rear direction and the pitch direction.

As shown in FIG. 6, the accommodating portion 255 of the present embodiment is opened rearward in the front-rear direction. The accommodating portion 255 is positioned rearward of the front holding portion 250 in the front-rear direction. The accommodating portion 255 has a top surface 2552 and an inner surface 2551. Specifically, the inner surface 2551 includes a bottom surface 2554. The top surface 2552 and the bottom surface 2554 face each other in the up-down direction. The top surface 2552 is positioned above the bottom surface 2554 in the up-down direction.

As shown in FIGS. 7 and 8, the rear holding portion 260 of the present embodiment is positioned around a rear end of the first housing 240. The rear holding portion 260 protrudes inward in the up-down direction from the inner surface 2551 of the accommodating portion 255. More specifically, the rear holding portion 260 includes four rear ribs 262. Each of two of the rear ribs 262 protrudes downward in the up-down direction from the top surface 2552 of the accommodating portion 255. Each of remaining two of the rear ribs 262 protrudes upward in the up-down direction from the bottom surface 2554 of the accommodating portion 255.

As shown in FIG. 8, the rear holding portion 260 of the present embodiment indirectly holds the cable 800 when the first connector 200 is attached to the cable 800. However, the present invention is not limited thereto. The rear holding portion 260 may be modified, provided that the rear holding portion 260 directly or indirectly holds the cable 800 when the first connector 200 is attached to the cable 800. The rear holding portion 260 regulates a movement of the cable 800 in the up-down direction when the first connector 200 is attached to the cable 800.

As shown in FIG. 6, the upper plate portion 241 of the present embodiment is positioned above the received portion 248 in the up-down direction. The upper plate portion 241 is positioned above the front holding portion 250 in the up-down direction. The upper plate portion 241 is positioned above the accommodating portion 255 in the up-down direction.

As shown in FIGS. 6 and 7, the upper plate portion 241 has a spring portion 244, a first press portion 242, a slope surface 245, a first lock portion 246 and an upper surface 247. In other words, the first housing 240 is provided with the first press portion 242 and is formed with the spring portion 244. In addition, the first housing 240 has the first lock portion 246.

Figure 5:
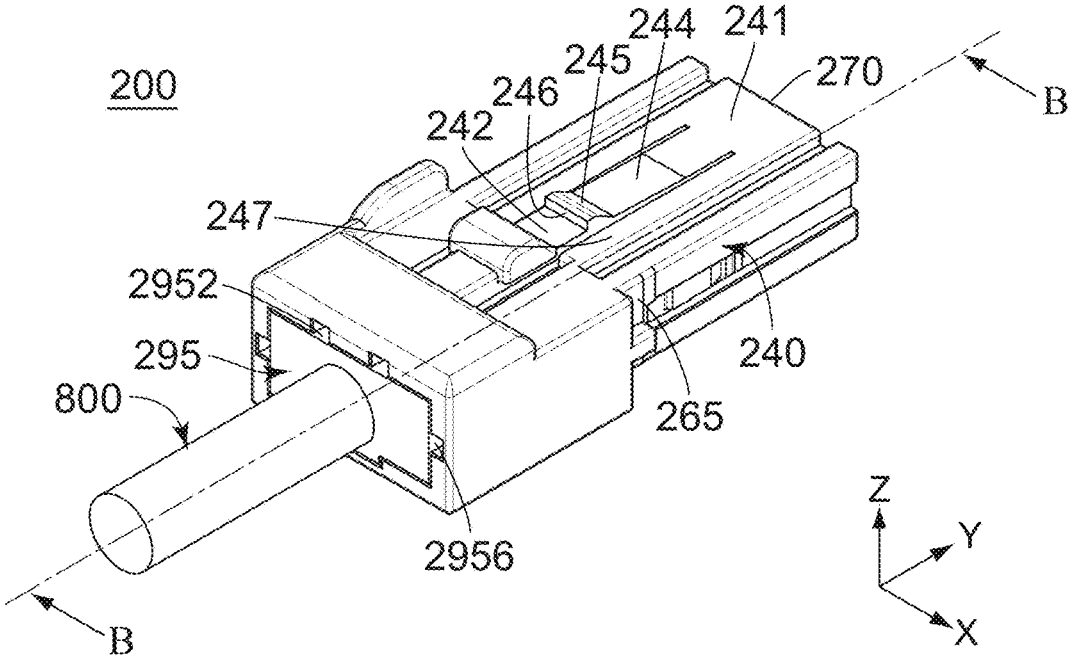
FIG. 5 is a rear, perspective view showing a first connector which is included in the connector assembly of FIG. 1.

Referring to FIG. 5, the spring portion 244 of the present embodiment has a plate-like shape intersecting with the up-down direction. The spring portion 244 is elastically deformable in the up-down direction.

As shown in FIG. 5, the first press portion 242 of the present embodiment is a plane intersecting with the up-down direction. The first press portion 242 faces upward in the up-down direction. The first press portion 242 is elastically supported by the spring portion 244 so as to be movable in the up-down direction.

As shown in FIG. 5, the slope surface 245 of the present embodiment is a plane oblique to the up-down direction. The slope surface 245 is positioned forward beyond the first press portion 242 in the front-rear direction. The slope surface 245 is positioned forward beyond the first lock portion 246 in the front-rear direction.

As shown in FIG. 5, the first lock portion 246 of the present embodiment is a plane intersecting with the front-rear direction. The first lock portion 246 faces rearward in the front-rear direction. The first lock portion 246 is elastically supported by the spring portion 244. The first lock portion 246 is positioned forward of the first press portion 242 in the front-rear direction.

As shown in FIG. 5, the upper surface 247 of the present embodiment is a plane perpendicular to the up-down direction. The upper surface 247 faces upward in the up-down direction. The upper surface 247 is positioned outward beyond the spring portion 244 in the pitch direction. As shown in FIG. 7, the upper surface 247 is positioned below the first press portion 242 in the up-down direction under an unmated state where the first connector 200 is not mated with the second connector 500. In other words, the first press portion 242 is positioned above the upper surface 247 in the up-down direction under the unmated state.

As shown in FIGS. 5 and 6, the outer circumference 265 of the present embodiment is positioned around a middle of the first housing 240 in the front-rear direction. The outer circumference 265 surrounds the accommodating portion 255 in a perpendicular plane perpendicular to the front-rear direction. The outer circumference 265 includes the first press portion 242 of the upper plate portion 241.

As shown in FIG. 6, the first inner structure 210 of the present embodiment comprises a first connector main body 220, a relay board 280, an additional shell 290 and a cable holding portion 295.

Referring to FIG. 6, the first connector main body 220 of the present embodiment is a plug which is mateable with a receptacle in accordance with a USB (Universal Serial Bus) 3.1 Type-C standard. The first connector main body 220 has a shape which is rotationally symmetric about the axis extending in the front-rear direction. The first connector main body 220 protrudes in the second connector main body accommodating portion 249 of the received portion 248 of the first housing 240. The first connector main body 220 extends in the front-rear direction. The first connector main body 220 is held by the first housing 240. A front end of the first connector main body 220 is positioned rearward beyond the front end 270 of the received portion 248 in the front-rear direction. The first connector main body 220 comprises a first holding member 224, a plurality of first terminals 222, a first shell 226 and a plate-like portion accommodating portion 228.

Referring to FIGS. 6 and 9, the first holding member 224 of the present embodiment is made of resin. The first holding member 224 extends in the front-rear direction.

As shown in FIG. 9, the first terminals 222 are held by the first holding member 224. The first terminals 222 are arranged in the pitch direction perpendicular to the front-rear direction. More specifically, the first terminals 222 are grouped into two rows. The two rows include an upper row and a lower row which are arranged in the up-down direction. The first terminals 222 of each row are arranged in the pitch direction. The first terminals 222 are arranged so as to be rotationally symmetric about the axis extending in the front-rear direction. The first terminals 222 are connected with the core wires 810, respectively, when the first connector 200 is attached to the cable 800. More specifically, the first terminals 222 are indirectly connected with the core wires 810, respectively, when the first connector 200 is attached to the cable 800.

Referring to FIG. 6, each of the first terminals 222 of the present embodiment is made of metal. Each of the first terminals 222 has a first contact point 2222 and a connecting portion 2224.

As shown in FIG. 6, the first contact point 2222 of the present embodiment is positioned around a front end of the first terminal 222. The first contact point 2222 faces inward in the up-down direction. The connecting portion 2224 is positioned around a rear end of the first terminal 222. The connecting portion 2224 faces inward in the front-rear direction.

Referring to FIGS. 6 and 9, the first shell 226 of the present embodiment is made of metal. The first shell 226 extends in the front-rear direction. The first shell 226 has a shape which is rotationally symmetric about the axis extending in the front-rear direction. The first shell 226 has a substantially race track shape when viewed from its front. In the perpendicular plane perpendicular to the front-rear direction, the first shell 226 has a race track shape which extends long in the pitch direction.

As understood from FIGS. 6 and 9, the first shell 226 of the present embodiment surrounds, at least in part, the first terminals 222 and the first holding member 224 in the perpendicular plane perpendicular to the front-rear direction. The first shell 226 is held by the front holding portion 250 of the first housing 240, and a movement of the first shell 226 in the up-down direction is regulated. In other words, the front holding portion 250 holds the first shell 226 and regulates the movement of the first shell 226 in the up-down direction.

Referring to FIG. 6, the first shell 226 is lightly press-fit or is press-fit into the front holding portion 250 from a rear end of the front holding portion 250 by crushing the front ribs 252. Specifically, the front holding portion 250 sandwiches the first shell 226 by reaction forces of the crushed front ribs 252 in the up-down direction. This structure enables the first connector main body 220 to be securely held by the first housing 240. However, the present invention is not limited thereto. The front holding portion 250 may be modified, for example, as follows. The front holding portion 250 has no front rib 252 and makes point or surface contact with the first shell 226. Additionally, in a case where the front holding portion 250 has the front rib 252, the number and arrangement of the front rib 252 may be modified as necessary.

As shown in FIGS. 6 and 9, the plate-like portion accommodating portion 228 of the present embodiment is a space extending in the front-rear direction. The plate-like portion accommodating portion 228 is surrounded by the first shell 226 in the perpendicular plane. The plate-like portion accommodating portion 228 is positioned between the first terminals 222 of the upper row and the first terminals 222 of the lower row in the up-down direction.

Referring to FIG. 2, the relay board 280 of the present embodiment electrically connects the core wires 810 with the first terminals 222. The relay board 280 comprises a base portion 282 which is made of insulator. The base portion 282 has a plate-like shape perpendicular to the up-down direction. Each of an upper surface and a lower surface of the base portion 282 is formed with a plurality of trace portions 283. Each of the trace portions 283 is a conductive trace which is formed on the base portion 282. In other words, the relay board 280 is provided with the plurality of trace portions 283.

As shown in FIG. 2, each of the trace portions 283 has a front contact point 2831, a rear contact point 2832 and a line 2834. The rear contact point 2832 is positioned rearward of the front contact point 2831 in the front-rear direction. The line 2834 extends along the front-rear direction and connects the front contact point 2831 and the rear contact point 2832 with each other.

Referring to FIG. 2, the trace portions 283 are provided to correspond to the first terminals 222, respectively. The first terminals 222 are brought into contact with the front contact points 2831 of the trace portions 283, respectively. In detail, referring to FIGS. 2 and 6, the connecting portion 2224 of each of the first terminals 222 is brought into contact with the front contact point 2831 of the trace portion 283 corresponding thereto. The rear contact points 2832 are configured to be brought into contact with the core wires 810, respectively, of the cable 800. In other words, the trace portions 283 are configured to connect the first terminals 222 with the core wires 810, respectively, of the cable 800.

Referring to FIG. 6, the additional shell 290 of the present embodiment is made of metal. The additional shell 290 is positioned in the accommodating portion 255. The additional shell 290 is positioned rearward of the front holding portion 250 in the front-rear direction. As shown in FIG. 2, the additional shell 290 surrounds the relay board 280 in the perpendicular plane. Specifically, the additional shell 290 electromagnetically shields the relay board 280. The additional shell 290 is fixed to the first shell 226 so as to be immovable relative to the first shell 226. The additional shell 290 is electrically connected with the first shell 226. The additional shell 290 is fixed to the cable 800.

As shown in FIG. 8, the cable holding portion 295 of the present embodiment is a portion which holds the cable 800 in the perpendicular plane.

As shown in FIG. 8, the cable holding portion 295 of the present embodiment has a rectangular shape in the perpendicular plane. In detail, the cable holding portion 295 of the present embodiment has an upper surface 2952, a lower surface 2954 and two side surfaces 2956. Each of the upper surface 2952 and the lower surface 2954 is a plane perpendicular to the up-down direction. The upper surface 2952 defines an upper end of the cable holding portion 295 in the up-down direction. The upper surface 2952 is positioned above the lower surface 2954 in the up-down direction. The lower surface 2954 is divided into two parts which are arranged in the pitch direction. Each of the side surfaces 2956 is a plane perpendicular to the pitch direction. The two side surfaces 2956 are positioned at opposite ends, respectively, of the cable holding portion 295 in the pitch direction.

Referring to FIGS. 2 and 8, the cable holding portion 295 of the present embodiment is positioned in the accommodating portion 255 of the first housing 240. The cable holding portion 295 is held by the first housing 240. The cable holding portion 295 is held on the first housing 240 by the rear holding portion 260.

Referring to FIG. 8, the cable holding portion 295 is lightly press-fit or is press-fit into the rear holding portion 260 from a rear end of the rear holding portion 260 by crushing the rear ribs 262. Specifically, the rear holding portion 260 sandwiches the cable holding portion 295 by reaction forces of the crushed rear ribs 262 in the up-down direction. This structure enables the cable holding portion 295 to be securely held by the first housing 240. However, the present embodiment is not limited thereto. The rear holding portion 260 may be modified, for example, as follows. The rear holding portion 260 has no rear rib 262 and makes point or surface contact with the cable holding portion 295. Additionally, in a case where the rear holding portion 260 has the rear rib 262, the number and arrangement of the rear rib 262 may be modified as necessary.

As shown in FIG. 8, in the up-down direction, the upper surface 2952 of the cable holding portion 295 is brought into contact with the two rear ribs 262 each protruding downward from the top surface 2552 of the accommodating portion 255. In the up-down direction, the lower surface 2954 of the cable holding portion 295 is brought into contact with the remaining two rear ribs 262 each protruding upward from the bottom surface 2554 of the accommodating portion 255.

Figure 11:
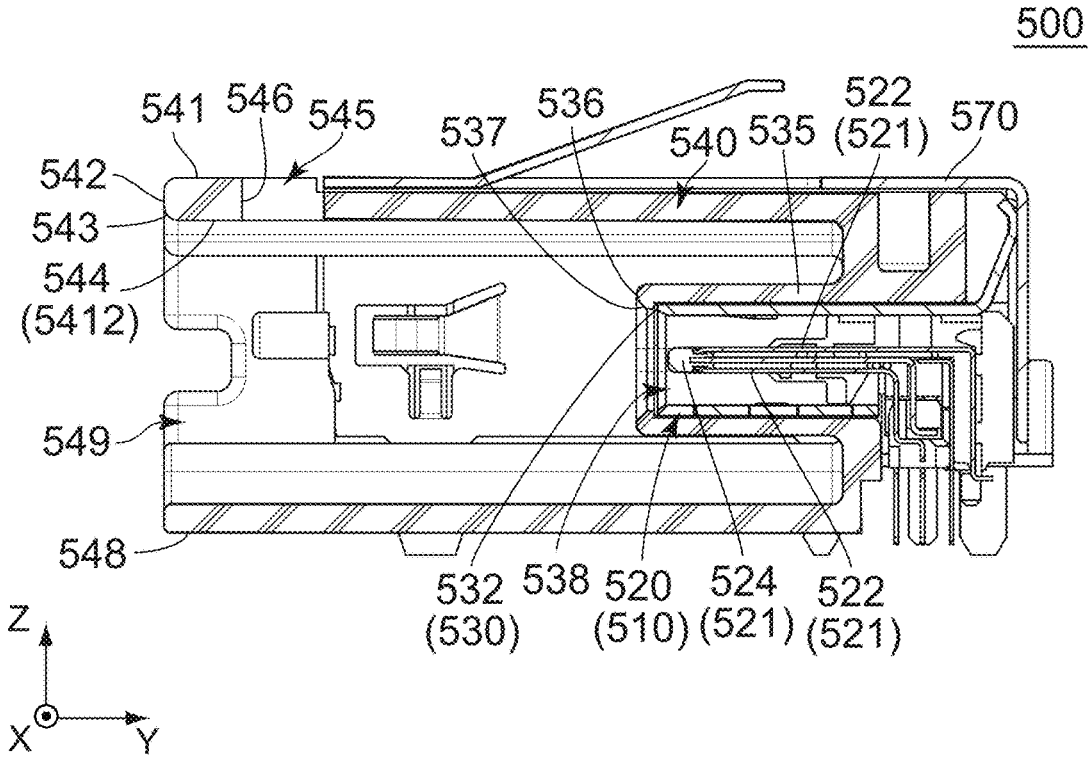
FIG. 11 is a cross-sectional view showing the second connector of FIG. 10, taken along line D-D.

As shown in FIG. 11, the second connector 500 of the present embodiment comprises a second housing 540, a second inner structure 510 and an outer shell 570.

Figure 10:
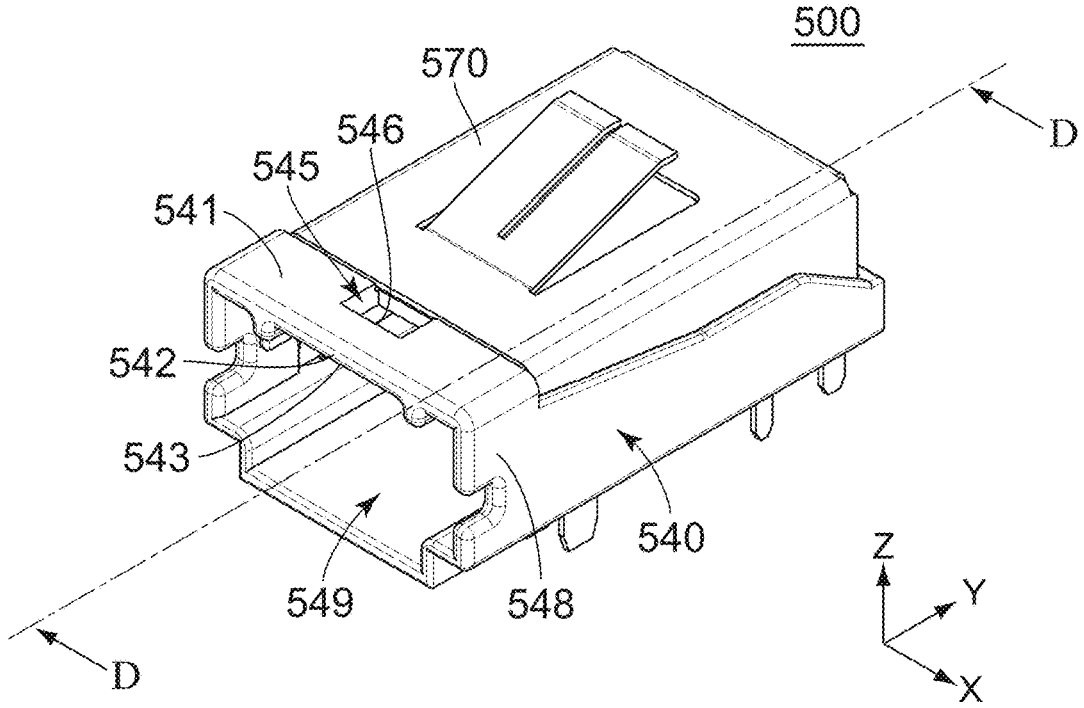
FIG. 10 is a rear, perspective view showing a second connector which is included in the connector assembly of FIG. 1.

As shown in FIGS. 10 and 11, the second housing 540 of the present embodiment has a substantially rectangular tube shape extending in the front-rear direction. The second housing 540 accommodates and holds the second inner structure 510. As shown in FIG. 2, the second housing 540 partially receives the first housing 240 under a mated state where the first connector 200 and the second connector 500 are mated with each other.

As shown in FIG. 11, the second housing 540 of the present embodiment has a receiving portion 548, an upper plate portion 541 and a second shell holding portion 535.

Figure 12:
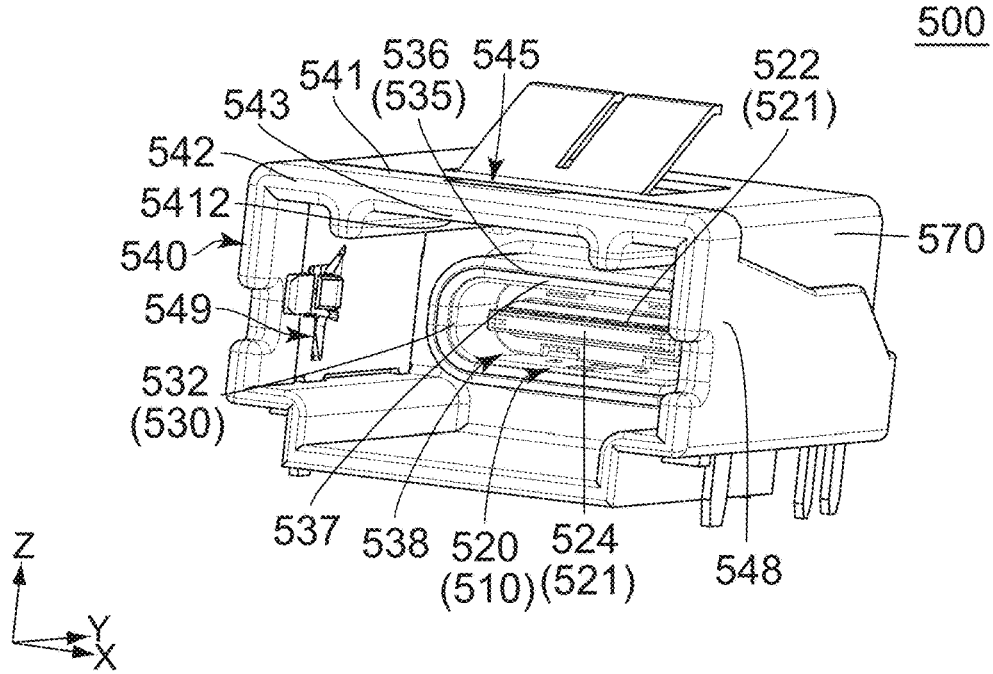
FIG. 12 is another rear, perspective view showing the second connector of FIG. 10.
Figure 13:
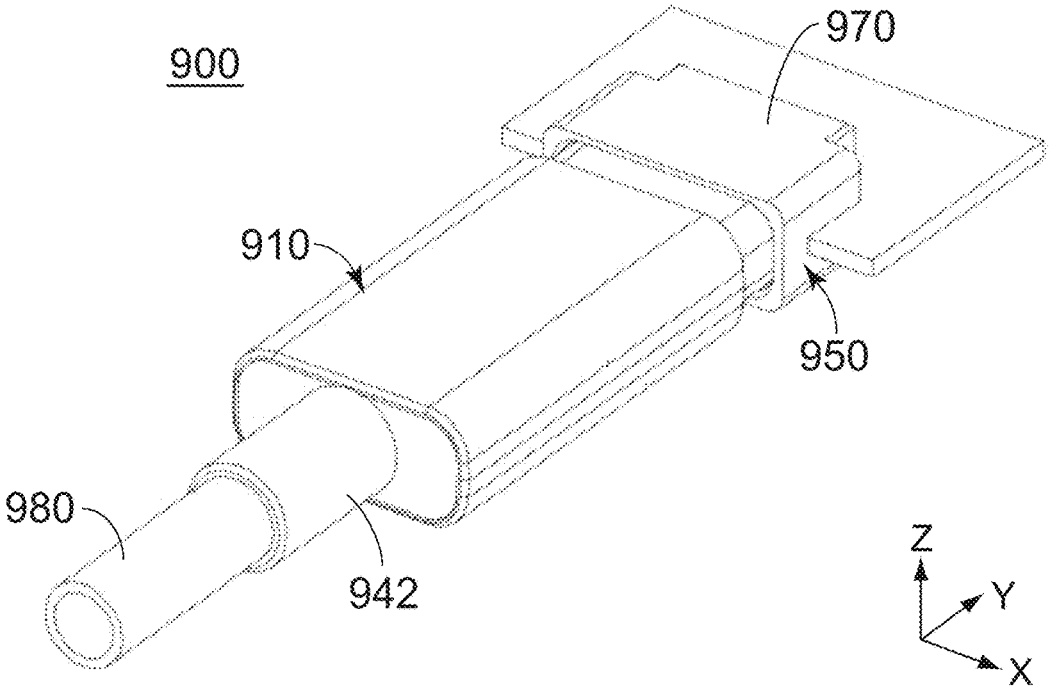
FIG. 13 PRIOR ART
FIG. 13 is a perspective view showing a connector assembly of Patent Document 1.
Figure 14:
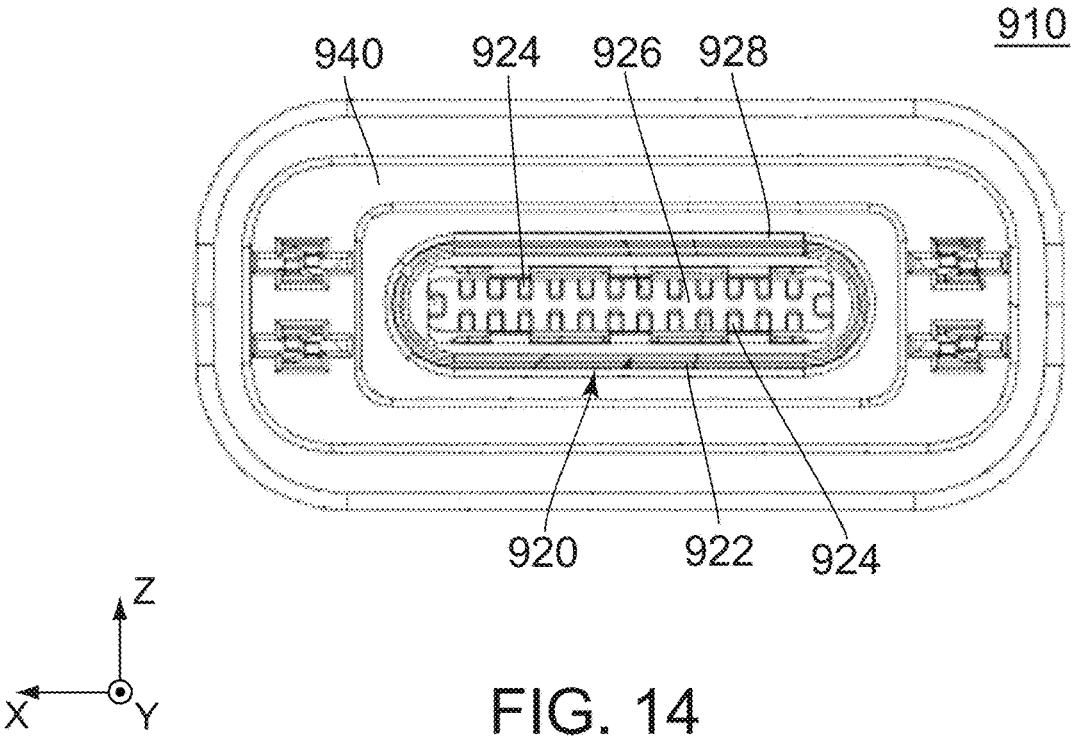
FIG. 14 PRIOR ART
FIG. 14 is a front view showing a first connector which is included in the connector assembly of FIG. 13.
Figure 15:
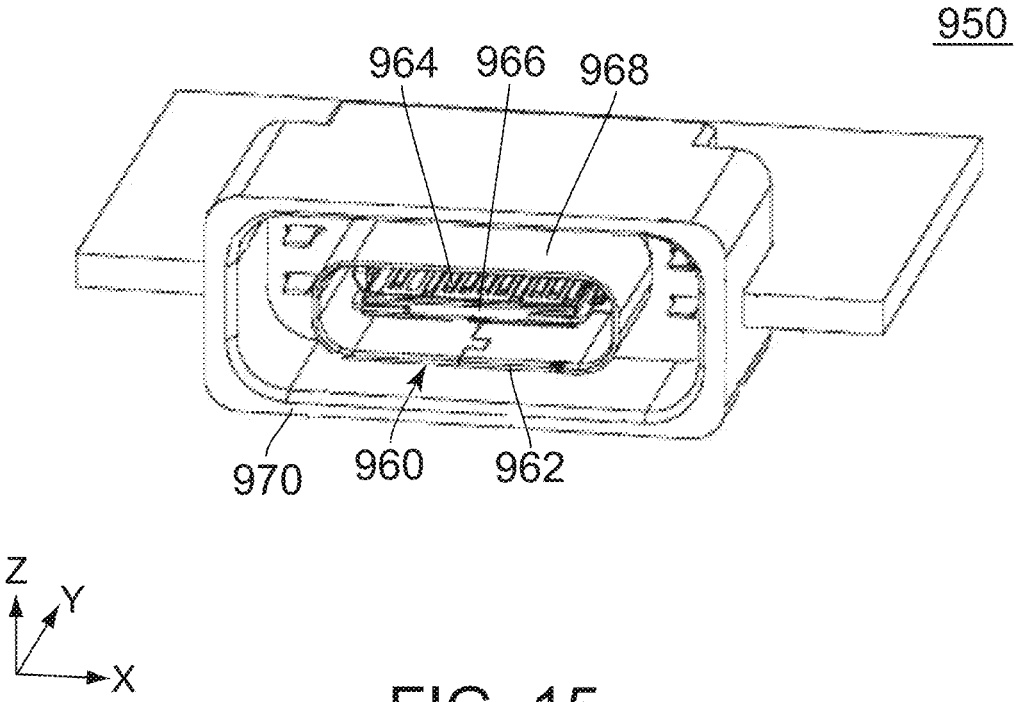
FIG. 15 PRIOR ART
FIG. 15 is a rear, perspective view showing a second connector which is included in the connector assembly of FIG. 13.

As shown in FIG. 12, the receiving portion 548 of the present embodiment has a shape which is rotationally asymmetric about the axis extending in the front-rear direction. As shown in FIG. 11, the receiving portion 548 is opened rearward in the front-rear direction. The receiving portion 548 has a received portion accommodating portion 549. The receiving portion 548 has a rear end 542 in the front-rear direction. In other words, the second housing 540 has the rear end 542 in the front-rear direction. As shown in FIG. 2, the receiving portion 548 receives the received portion 248 when the first connector 200 is mated with the second connector 500. Since each of the received portion 248 and the receiving portion 548 has the shape which is rotationally asymmetric about the axis extending in the front-rear direction as described above, the connector assembly 100 of the present embodiment is configured to prevent reverse insertion of the first connector 200 into the second connector 500.

As shown in FIG. 12, the received portion accommodating portion 549 of the present embodiment is a space which extends, in the front-rear direction, in the receiving portion 548. As shown in FIG. 2, the received portion accommodating portion 549 accommodates the received portion 248 of the first connector 200 under the mated state.

As shown in FIG. 12, the rear end 542 of the present embodiment is the rearmost end of the second connector 500 in the front-rear direction. The rear end 542 is positioned rearward beyond the second inner structure 510 in the front-rear direction. In other words, the second inner structure 510 does not protrude rearward in the front-rear direction beyond the rear end 542 of the receiving portion 548.

As shown in FIGS. 2 and 6 to 8, the rear end 542 of the second housing 540 is positioned between the front holding portion 250 and the rear holding portion 260 in the front-rear direction under the mated state where the first connector 200 and the second connector 500 are mated with each other. Accordingly, the connector assembly 100 of the present embodiment has a reduced dimension in the up-down direction while having an increased strength against an external force which is applied to the cable 800.

Figure 4:
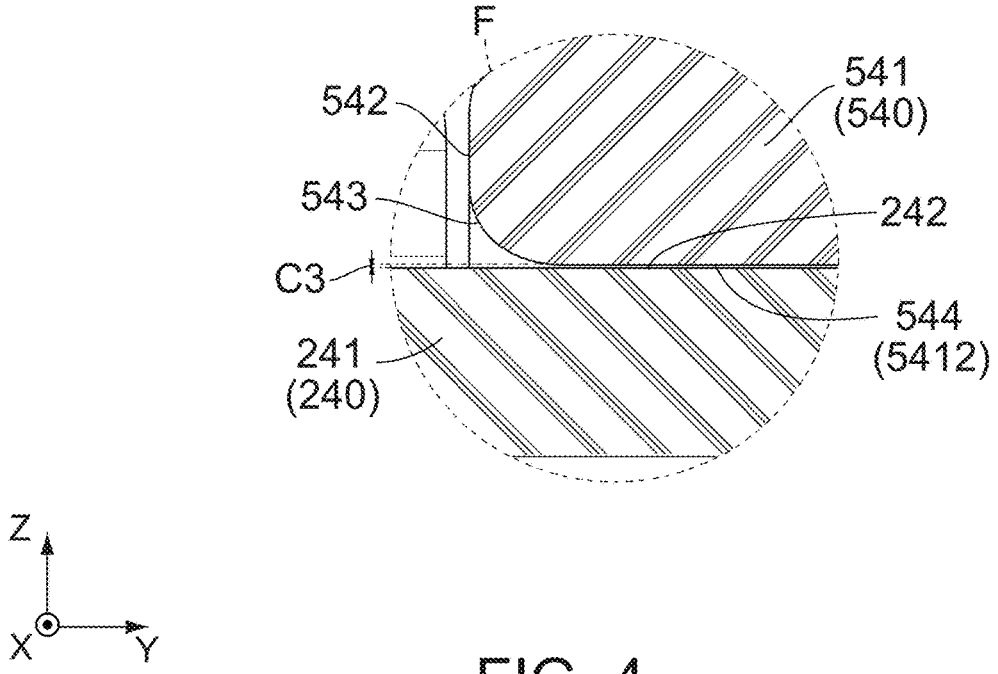
FIG. 4 is an enlarged, cross-sectional view showing a part which is enclosed by dotted line F of FIG. 2.

As shown in FIG. 11, the upper plate portion 541 of the present embodiment is positioned at a rear end of the second housing 540 in the front-rear direction. The upper plate portion 541 is positioned at an upper end of the second housing 540 in the up-down direction. The upper plate portion 541 has a lower surface 5412. The lower surface 5412 is a plane perpendicular to the up-down direction. The lower surface 5412 faces downward in the up-down direction. Referring to FIGS. 4 and 5, when the first connector 200 is mated with the second connector 500, the lower surface 5412 is positioned above the upper surface 247 of the upper plate portion 241 of the first housing 240 of the first connector 200 in the up-down direction. More specifically, referring to FIGS. 5 and 12, the lower surface 5412 is brought into contact with the upper surface 247 from above in the up-down direction when the first connector 200 is mated with the second connector 500.

As shown in FIG. 11, the upper plate portion 541 of the present embodiment is provided with an abutting portion 543, a hole 545 and a second press portion 544. In other words, the second housing 540 is provided with the second press portion 544.

As shown in FIG. 11, in a plane perpendicular to the pitch direction, the abutting portion 543 of the present embodiment has an arc-shape which is arced rearward in the front-rear direction and downward in the up-down direction. The abutting portion 543 is positioned rearward of the second press portion 544 in the front-rear direction. Referring to FIGS. 6 and 11, when the first connector 200 and the second connector 500 are mated with each other, the abutting portion 543 abuts against the slope surface 245 of the first connector 200 to move the first press portion 242 and the first lock portion 246 downward.

As shown in FIG. 11, the hole 545 of the present embodiment pierces the upper plate portion 541 in the up-down direction. The hole 545 has a second lock portion 546. In other words, the second housing 540 has the second lock portion 546.

As shown in FIG. 11, the second lock portion 546 of the present embodiment is a part of an inner surface of the hole 545. The part of the inner surface of the hole 545 is positioned at a rear end of the hole 545. The second lock portion 546 faces forward in the front-rear direction. The second lock portion 546 is a plane perpendicular to the front-rear direction. As shown in FIG. 2, the second lock portion 546 locks the mated state together with the first lock portion 246 when the first connector 200 and the second connector 500 are mated with each other. In other words, the second lock portion 546 and the first lock portion 246 lock the mated state where the first connector 200 and the second connector 500 are mated with each other.

As shown in FIG. 11, the second press portion 544 of the present embodiment is a plane perpendicular to the up-down direction. The second press portion 544 is a part of the lower surface 5412 of the upper plate portion 541. In the front-rear direction, the second press portion 544 is provided on the rear end 542 of the second housing 540 or on the vicinity of the rear end 542 of the second housing 540. The second press portion 544 is positioned between the rear end 542 and the second lock portion 546 of the second housing 540 in the front-rear direction. Specifically, in the front-rear direction, the second press portion 544 is positioned forward of the rear end 542 and rearward of the second lock portion 546.

As described above, the first press portion 242 is elastically supported by the spring portion 244 so as to be movable in the up-down direction, while the first press portion 242 is positioned above the upper surface 247 in the up-down direction under the unmated state where the first connector 200 is not mated with the second connector 500. This enables that, when the first connector 200 is mated with the second connector 500, the first press portion 242 is pushed downward to reach the same position as that of the upper surface 247 in the up-down direction and is then brought into contact with the second press portion 544 in the up-down direction while the first press portion 242 receives an upward elastic force from the spring portion 244. In other words, the first press portion 242 is pressed against the second press portion 544 by the elastic force of the spring portion 244 under the mated state. More specifically, the first press portion 242 is pressed from below against the second press portion 544 by the elastic force of the spring portion 244 under the mated state. The pressing of the first press portion 242 against the second press portion 544 regulates a relative movement of the rear end 542 of the second housing 540 with respect to the first housing 240 in the up-down direction.

Referring to FIG. 2, under the mated state, the first press portion 242 is pressed against the second press portion 544 so that the relative movement of the rear end 542 of the second housing 540 with respect to the first housing 240 in the up-down direction is regulated. However, the present invention is not limited thereto. The connector assembly 100 may be modified as follows: one of the first press portion 242 and the second press portion 544 is a rib; and the first housing 240 is lightly press-fit into the second housing 540 by crushing the rib when first connector 200 is mated with the second connector 500.

Figure 3:
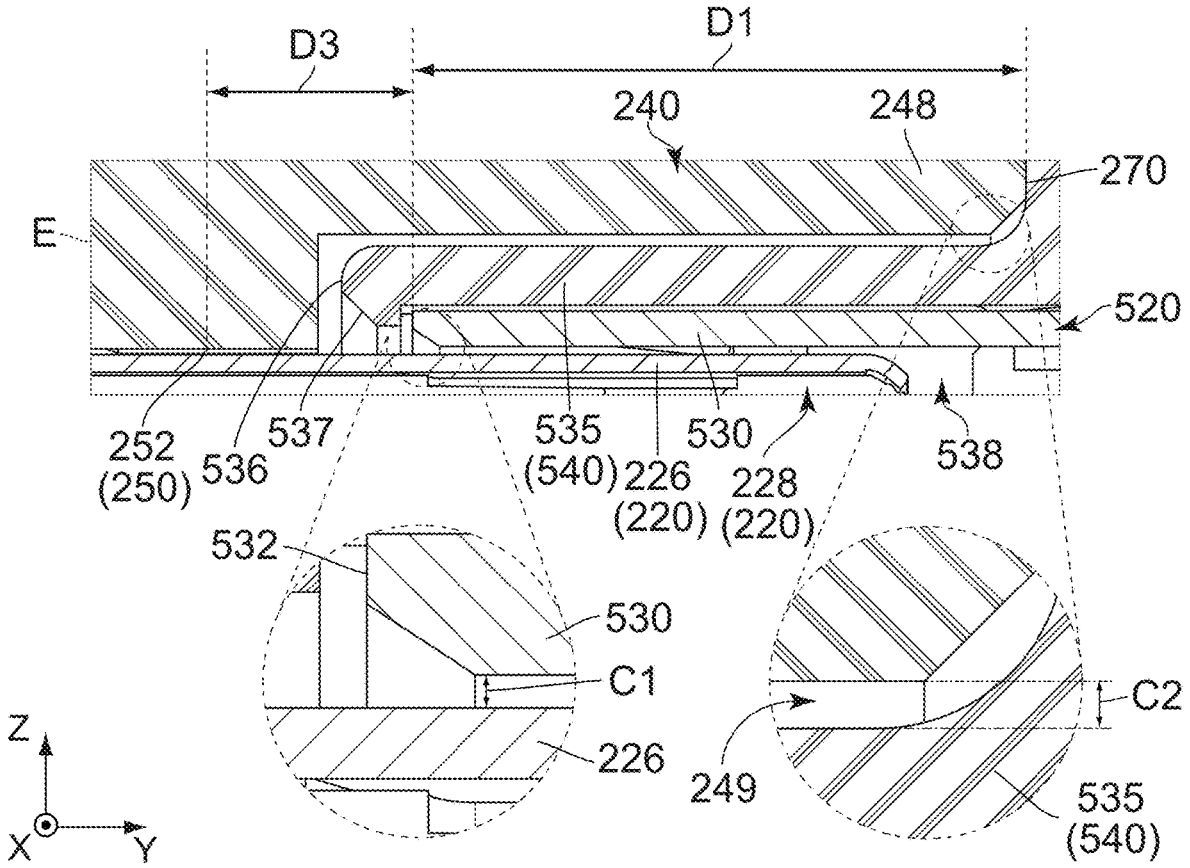
FIG. 3 is an enlarged, cross-sectional view showing a part which is enclosed by dotted line E of FIG. 2. A rear end of a second shell, a front end of a first housing and their surrounding parts are illustrated enlarged in the figure.

Referring to FIGS. 11 and 12, the second shell holding portion 535 of the present embodiment is made of resin. Specifically, the second shell holding portion 535 extends in the front-rear direction. The second shell holding portion 535 has a substantially race track shape when viewed from its rear. In the perpendicular plane, the second shell holding portion 535 has a race track shape which extends long in the pitch direction. As shown in FIG. 3, the second shell holding portion 535 is accommodated in the second connector main body accommodating portion 249 when the first connector 200 is mated with the second connector 500.

As shown in FIG. 11, the second shell holding portion 535 has a rear end 536 in the front-rear direction. The rear end 536 is positioned forward beyond the rear end 542 of the receiving portion 548. The rear end 536 is provided with a guide surface 537. The guide surface 537 is inclined to extend forward in the front-rear direction and inward in the up-down direction.

As shown in FIG. 11, the second inner structure 510 of the present embodiment comprises a second connector main body 520.

As shown in FIG. 11, the second connector main body 520 of the present embodiment is a receptacle which is mateable with a plug in accordance with a USB (Universal Serial Bus) 3.1 Type-C standard. The second connector main body 520 has a shape which is rotationally symmetric about the axis extending in the front-rear direction. The second connector main body 520 is accommodated in and held by the second housing 540. In other words, the second housing 540 accommodates and hold the second connector main body 520. As shown in FIG. 2, the second connector main body 520 is mated with the first connector main body 220 under the mated state where the first connector 200 and the second connector 500 are mated with each other.

As described above, the movement of the first inner structure 210 in the up-down direction is regulated by the front holding portion 250, the cable 800 attached with the first connector 200 is regulated in its movement in the up-down direction by the rear holding portion 260, and the relative movement of the rear end 542 of the second housing 540 with respect to the first housing 240 in the up-down direction is regulated. These three regulations can provide a positive alignment of a mating axis of the first connector main body 220 with a mating axis of the second connector main body 520 when the first connector 200 and the second connector 500 are mated with each other. Thus, the first connector 200 and the second connector 500 are smoothly mated with each other.

As shown in FIG. 11, the second connector main body 520 of the present embodiment comprises a plate-like portion 521, a second shell 530 and a first connector main body accommodating portion 538.

As shown in FIG. 2, the plate-like portion 521 of the present embodiment is accommodated in the plate-like portion accommodating portion 228 of the first connector main body 220 of the first connector 200 when the first connector 200 is mated with the second connector 500. As shown in FIG. 11, the plate-like portion 521 comprises a second holding member 524 and a plurality of second terminals 522. In other words, the second connector main body 520 comprises the second holding member 524 and the plurality of second terminals 522.

Referring to FIGS. 11 and 12, the second holding member 524 of the present embodiment is made of insulator. The second holding member 524 has a flat plate shape perpendicular to the up-down direction. The second holding member 524 holds the second terminals 522.

Referring to FIGS. 11 and 12, each of the second terminals 522 of the present embodiment is made of metal. The second terminals 522 are arranged in the pitch direction. More specifically, the second terminals 522 are grouped into two rows which are arranged in the up-down direction. The second terminals 522 of each row are arranged in the pitch direction. The second terminals 522 are arranged so as to be rotationally symmetric about the axis extending in the front-rear direction. As shown in FIG. 2, the second terminals 522 are connected with the first terminals 222, respectively, under the mated state. When the first connector 200 attached to the cable 800 is mated with the second connector 500, each of the core wires 810 of the cable 800 is connected with the second terminal 522 through the corresponding trace portion 283 of the relay board 280 and the corresponding first terminal 222.

Referring to FIGS. 11 and 12, the second shell 530 of the present embodiment is made of metal. Specifically, the second shell 530 extends in the front-rear direction. The second shell 530 has a shape which is rotationally symmetric about the axis extending in the front-rear direction. The second shell 530 has a substantially race track shape when viewed from its rear. In the perpendicular plane, the second shell 530 has a race track shape which extends long in the pitch direction.

As understood from FIGS. 11 and 12, the second shell 530 surrounds, at least in part, the plate-like portion 521 in the perpendicular plane perpendicular to the front-rear direction. Specifically, the second shell 530 surrounds, at least in part, the second terminals 522 and the second holding member 524 in the perpendicular plane perpendicular to the front-rear direction. As shown in FIG. 3, the second shell 530 partially receives the first shell 226 under the mated state. The second shell 530 has a rear end 532 in the front-rear direction. The rear end 532 is the rearmost end of the second shell 530 in the front-rear direction. As shown in FIGS. 11 and 12, the second shell 530 is surrounded by the second shell holding portion 535 in the perpendicular plane. The rear end 532 of the second shell 530 is positioned forward beyond the rear end 536 of the second shell holding portion 535 in the front-rear direction.

As understood from FIGS. 2 and 3, in the front-rear direction, a distance D1 from the front end 270 of the first housing 240 to the rear end 532 of the second shell 530 is shorter than a distance D2 from the rear end 542 of the second housing 540 to the rear end 532 of the second shell 530 under the mated state. Accordingly, when an external force is applied to the cable 800 under the mated state, the rear end 542 of the second housing 540, which is nearer to the cable 800 than the rear end 532 of the second shell 530, abuts against the outer circumference 265 of the first housing 240 to regulate a movement of the cable 800, and then the front end 270 of the received portion 248 of the first housing 240 abuts against the receiving portion 548 of the second housing 540 in the received portion accommodating portion 549 to further regulate the movement of the cable 800. These abutments can effectively distribute a force which is applied to mating parts of the first shell 226 and the second shell 530. In other words, the connector assembly 100 of the present invention prevents the mating parts of the first shell 226 and the second shell 530 from being broken when an external force is applied to the cable 800 under the mated state.

As understood from FIGS. 3 and 4, in the up-down direction, a clearance C1 between the rear end 532 of the second shell 530 and the first shell 226 is smaller than a clearance C2 between the front end 270 of the first housing 240 and the second housing 540 under the mated state. Additionally, in the up-down direction, the clearance C1 is equal to or greater than a clearance C3 between the rear end 542 of the second housing 540 and the first housing 240 under the mated state. In the present embodiment, the clearance C3 in the mated state is zero.

As understood from FIGS. 2 and 3, in the front-rear direction, a distance D3 from the rear end 532 of the second shell 530 to the front holding portion 250 is smaller than a distance D4 from the front holding portion 250 to the rear holding portion 260 under the mated state.

As shown in FIG. 11, the first connector main body accommodating portion 538 of the present embodiment is a space extending in the front-rear direction. The first connector main body accommodating portion 538 is surrounded by the second shell 530 in the perpendicular plane. The first connector main body accommodating portion 538 surrounds the plate-like portion 521 in the perpendicular plane. As shown in FIGS. 2 and 3, when the first connector 200 is mated with the second connector 500, the first connector main body 220 is accommodated in the first connector main body accommodating portion 538. As described above, the rear end 536 of the second shell holding portion 535 is provided with the guide surface 537. Thus, if a front end of the first shell 226 abuts against the rear end 536 of the second shell holding portion 535 upon the mating of the first connector 200 with the second connector 500, the first connector main body 220 is smoothly guided into the first connector main body accommodating portion 538 to be mated with the second connector main body 520.

Referring to FIGS. 10 and 11, the outer shell 570 of the present embodiment is made of metal. Specifically, the outer shell 570 partially covers a front part of the second housing 540. The second shell 530 of the second connector main body 520 is electrically connected with the outer shell 570.

Although the specific explanation about the present invention is made above referring to the embodiments, the present invention is not limited thereto and is susceptible to various modifications and alternative forms.

Although the first connector main body 220 of the first connector 200 of the present embodiment is a plug which is mateable with a receptacle in accordance with a USB (Universal Serial Bus) 3.1 Type-C standard while the second connector main body 520 of the second connector 500 of the present embodiment is a receptacle which is mateable with a plug in accordance with a USB (Universal Serial Bus) 3.1 Type-C standard, the present invention is not limited thereto. For example, the shape, number and arrangement of the first terminal 222 may be freely modified. Similarly, for example, the shape, number and arrangement of the second terminal 522 may be freely modified.

Although the connector assembly 100 of the present embodiment is configured to prevent reverse insertion of the first connector 200 into the second connector 500 as described above, the present invention is not limited thereto. The connector assembly 100 may be modified so that the second connector 500 is capable of reversely mating with the first connector 200. Specifically, in order that the second connector 500 is capable of reversely mating with the first connector 200, wherein the second connector 500 is mated with the first connector 200 which is even upside down, the first connector 200 and the second connector 500 may be modified as follows. The received portion 248 has a shape which is rotationally symmetric about the axis extending in the front-rear direction. The receiving portion 548 has a shape which is rotationally symmetric about the axis extending in the front-rear direction. The receiving portion 548 is formed with an additional second lock portion which has a structure similar to that of the second lock portion 546. The received portion 248 is received in the receiving portion 548 under a reverse mated state where the second connector 500 is reversely mated with the first connector 200. The additional second lock portion and the first lock portion 246 lock the reverse mated state. In the modified first connector 200 and the modified second connector 500, the first connector main body 220 and the second connector main body 520 function as interfaces which are to be mated with each other. As described above, each of the first connector main body 220 and the second connector main body 520 has the shape which is rotationally symmetric about the axis extending in the front-rear direction. Thus, the modified second connector 500 is capable of reversely mating with the modified first connector 200. In other words, the modified second connector 500 is mateable with the modified first connector 200 which is even upside down.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, the first connector being attachable to a cable having a plurality of core wires, the second connector being mateable with the first connector along a front-rear direction, wherein:

the first connector comprises a first inner structure and a first housing;

the first inner structure comprises a first connector main body;

the first connector main body comprises a plurality of first terminals, a first holding member and a first shell;

the first terminals are connected with the core wires, respectively, when the first connector is attached to the cable;

the first terminals are held by the first holding member;

the first terminals are arranged in a pitch direction perpendicular to the front-rear direction;

the first shell surrounds, at least in part, the first terminals and the first holding member in a perpendicular plane perpendicular to the front-rear direction;

the first housing has a front holding portion and a rear holding portion;

the first housing has a front end in the front-rear direction;

the front holding portion is positioned between the front end and the rear holding portion in the front-rear direction;

the front holding portion holds the first inner structure and regulates a movement of the first inner structure in an up-down direction which is perpendicular to both the front-rear direction and the pitch direction;

the rear holding portion directly or indirectly holds the cable when the first connector is attached to the cable;

the second connector comprises a second inner structure and a second housing;

the second inner structure comprises a second connector main body;

the second connector main body is mated with the first connector main body under a mated state where the first connector and the second connector are mated with each other;

the second connector main body comprises a plurality of second terminals, a second holding member and a second shell;

the second terminals are connected with the first terminals, respectively, under the mated state;

the second holding member holds the second terminals;

the second shell surrounds, at least in part, the second terminals and the second holding member in the perpendicular plane;

the second shell partially receives the first shell under the mated state;

the second shell has a rear end in the front-rear direction;

the second housing accommodates and holds the second connector main body;

the second housing partially receives the first housing under the mated state;

the second housing has a rear end in the front-rear direction; and a distance from the front end of the first housing to the rear end of the second shell is shorter than a distance from the rear end of the second housing to the rear end of the second shell in the front-rear direction under the mated state.

2. The connector assembly as recited in claim 1, wherein:

the first housing is provided with a first press portion;

the second housing is provided with a second press portion;

in the front-rear direction, the second press portion is provided on the rear end of the second housing or on the vicinity of the rear end of the second housing; and under the mated state, the first press portion is pressed against the second press portion so that a relative movement of the rear end of the second housing with respect to the first housing in the up-down direction is regulated.

3. The connector assembly as recited in claim 2, wherein:

the first housing is formed with a spring portion;

the first press portion is elastically supported by the spring portion so as to be movable in the up-down direction; and under the mated state, the first press portion is pressed against the second press portion by elastic force of the spring portion.

4. The connector assembly as recited in claim 3, wherein:

the first housing has a first lock portion;

the first lock portion is elastically supported by the spring portion;

the first lock portion is positioned forward of the first press portion in the front-rear direction;

the second housing has a second lock portion;

the second lock portion and the first lock portion lock the mated state; and the second press portion is positioned between the rear end of the second housing and the second lock portion in the front-rear direction.

5. The connector assembly as recited in claim 2, wherein the rear holding portion regulates a movement of the cable in the up-down direction when the first connector is attached to the cable.

6. The connector assembly as recited in claim 1, wherein a distance from the rear end of the second shell to the front holding portion is shorter than a distance from the front holding portion to the rear holding portion in the front-rear direction under the mated state.

7. The connector assembly as recited in claim 6, wherein the front holding portion holds the first shell and regulates a movement of the first shell in the up-down direction.

8. The connector assembly as recited in claim 1, wherein the rear end of the second housing is positioned between the front holding portion and the rear holding portion in the front-rear direction under the mated state.

9. The connector assembly as recited in claim 1, wherein:

a clearance between the rear end of the second shell and the first shell is smaller than a clearance between the front end of the first housing and the second housing in the up-down direction under the mated state; and the clearance between the rear end of the second shell and the first shell is equal to or greater than a clearance between the rear end of the second housing and the first housing in the up-down direction under the mated state.

10. The connector assembly as recited in claim 1, wherein:

the first shell has a shape which is rotationally symmetric about an axis extending in the front-rear direction;

the first housing has a received portion and a first lock portion;

the received portion has a shape which is rotationally symmetric about the axis;

the second shell has a shape which is rotationally symmetric about the axis;

the second housing has a receiving portion;

the receiving portion has a shape which is rotationally symmetric about the axis;

the receiving portion is formed with an additional second lock portion;

the second connector is capable of reversely mating with the first connector, wherein the second connector is mated with the first connector which is even upside down;

the received portion is received in the receiving portion under a reverse mated state where the second connector is reversely mated with the first connector; and the additional second lock portion and the first lock portion lock the reverse mated state.

* * * * *